US007622867B2

(12) United States Patent
Chen

(10) Patent No.: US 7,622,867 B2
(45) Date of Patent: Nov. 24, 2009

(54) COLD CATHODE FLUORESCENT LAMP AND BACKLIGHT MODULE USING SAME

(75) Inventor: Ga-Lane Chen, Guangdong (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 687 days.

(21) Appl. No.: 11/307,737

(22) Filed: Feb. 19, 2006

(65) Prior Publication Data

US 2006/0238128 A1 Oct. 26, 2006

(30) Foreign Application Priority Data

Apr. 23, 2005 (CN) ..... 2005 1 0034424

(51) Int. Cl.
*H01J 17/16* (2006.01)
*H01J 1/62* (2006.01)

(52) U.S. Cl. ..... 313/634; 313/485

(58) Field of Classification Search ..... 313/634, 313/607, 234, 484–485, 594
See application file for complete search history.

(56) References Cited

U.S. PATENT DOCUMENTS 5,572,088 A 11/1996 Aizawa et al.
6,268,694 B1 7/2001 Fujimoto
2002/0141173 A1* 10/2002 Lee et al. ..... 362/26
2004/0114114 A1* 6/2004 Yano et al. ..... 353/84
2005/0179359 A1* 8/2005 Fran et al. ..... 313/495
2005/0179389 A1* 8/2005 Matsuo et al. ..... 313/634

FOREIGN PATENT DOCUMENTS

CN 1379267 A 11/2002

* cited by examiner

*Primary Examiner*—Nimeshkumar D. Patel
*Assistant Examiner*—Anne M Hines
(74) *Attorney, Agent, or Firm*—Winston Hsu

(57) ABSTRACT

A cold cathode fluorescent lamp includes: a working gas, a transparent tube, a fluorescent layer, an anode, a cold cathode and a light cut filter film. The transparent tube receives a working gas, and has an inner surface and an outer surface. The fluorescent layer is formed on the inner surface of the transparent tube. The light cut filter film is formed on the outer surface of the transparent tube. The cold cathode is disposed at one end of the transparent tube and the anode is disposed at the other end of the transparent tube. The cold cathode fluorescent lamp can block most part of the ultraviolet lights and infrared lights to irradiate at the light guide plate, whereby the light guide plate has a long service life without following problems such as thermal deformation, deflection, turn color and transformation.

16 Claims, 5 Drawing Sheets

COLD CATHODE FLUORESCENT LAMP AND BACKLIGHT MODULE USING SAME

FIELD OF THE INVENTION

The present invention relates to cold cathode fluorescent lamp and backlight module, particularly, to a cold cathode fluorescent lamp and backlight module for use in, e.g., a liquid crystal display (LCD).

DESCRIPTION OF RELATED ART

In a liquid crystal display device, liquid crystal is a substance that does not itself radiate light. Instead, the liquid crystal relies on receiving light from a light source, thereby displaying images and data. In the case of a typical liquid crystal display device, a backlight module powered by electricity supplies the needed light.

Conventional light sources used in the backlight modules generally include light emitting diodes (LEDs), and cold cathode fluorescent lamps (CCFLs). However, the LED has a shortcoming of low luminous efficiency and is often used in small size liquid crystal displays such as cell phone, personal data assist (PDA) and so on.

Referring to FIG. 1 (Prior art), a conventional CCFL 100 is shown. The CCFL 100 includes a transparent tube 110, a cold cathode 134, an anode 132, and a fluorescent layer 140. The fluorescent layer 140 is formed on an inner surface of the transparent tube 110. The cold cathode 134 and the anode 132 are respectively disposed at the two ends of transparent tube 110 and are respectively electrically connected to an exterior power source (no shown). The transparent tube 110 is filled with mercury vapor 120 and an inert gas 150.

When the power source supplys a current to the cold cathode 134 and the anode 132, an electric field therebetween is produced. Electrons are emitted from the cold cathode 134. The electrons are accelerated by the electric field and then collide with gaseous molecules of the mercury vapor and the inert gas. This causes excitation of the mercury vapor and subsequent remission. The remission process causes radiation of ultraviolet rays. The ultraviolet rays irradiate a fluorescent material of the fluorescent layer 140, whereby a part of the ultraviolet rays are converted into visible light and infrared light which produces a great deal of heat energy.

A conventional backlight module generally includes a light guide plate and a light source. When the CCFL 100 is used as a light source in the backlight module, the CCFL 100 is disposed adjacent a light guide plate of the backlight module. Infrared light and a part of ultraviolet light emitted from the CCFL 100 irradiate the light guide plate directly. Because the light guide plate is usually formed of transparent synthetic resin material, such as polymethyl methacrylate (PMMA) and polycarbonate (PC), the light guide plate has thermal deformation and deflection problems by absorbing a great deal of heat energy produced by the infrared light, and may have turn color and transformation problems due to long-term irradiation by the ultraviolet light. It caused serious problems on illuminance uniformity, poor brightness, and worse optical performance of the backlight module of the LCD.

What is needed, therefore, is a cold cathode fluorescent lamp which can reduce the emission of ultraviolet light and infrared light.

SUMMARY OF INVENTION

A CCFL according to a preferred embodiment includes a working gas; a transparent tube receiving the working gas therein, the transparent tube having an inner surface and an outer surface; a fluorescent layer formed on the inner surface of the transparent tube; a cold cathode disposed at one end of the transparent tube; an anode disposed at the other end of the transparent tube; and a filter film formed on the outer surface of the transparent tube.

A backlight module according to a preferred embodiment includes a light guide plate and a CCFL. The light guide plate includes an incident surface. The CCFL is disposed adjacent the incident surface of the light guide plate. The same CCFL as described in the previous paragraph is employed in this embodiment.

Other advantages and novel features will become more apparent from the following detailed description of preferred embodiments when taken in conjunction with the accompanying drawings, in which:

BRIEF DESCRIPTION OF DRAWINGS

Many aspects of the CCFL and related backlight module having the same can be better understood with reference to the following drawings. The components in the drawings are not necessarily to scale, the emphasis instead being placed upon clearly illustrating the principles of the present CCFL and backlight module using the CCFL. Moreover, in the drawings, like reference numerals designate corresponding parts throughout the several views.

DETAILED DESCRIPTION

Reference will now be made to the drawings to describe preferred embodiments of the present invention in detail.

Figure 1:
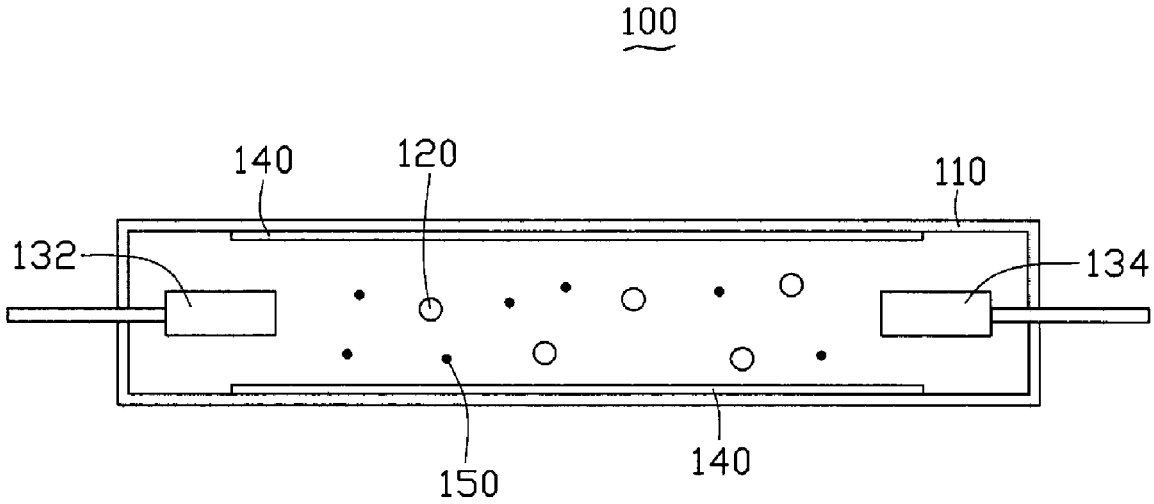
FIG. 1 (PRIOR ART)
FIG. 1 is a schematic, cross-sectional view of a conventional CCFL.
Figure 2:
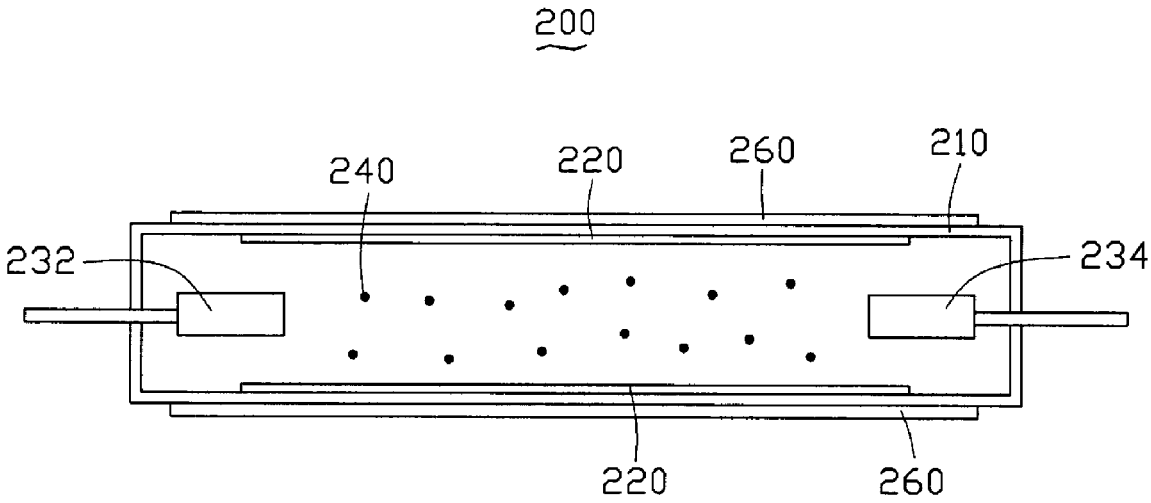
FIG. 2 is a schematic, cross-sectional view of a CCFL according to a first preferred embodiment.

Referring to FIG. 2, a CCFL 200, in accordance with a first embodiment, is shown. The CCFL 200 includes a transparent tube 210, a fluorescent layer 220, an anode 232, a cold cathode 234, and a light cut filter film 260. The transparent tube 210 is sealed in a form of cylinder and filled with a working gas 240. The transparent tube 210 has an inner surface and an outer surface. The fluorescent layer 220 is formed on the inner surface of the transparent tube 210. The light cut filter film 260 is deposited on the outer surface of the transparent tube 210. The cold cathode 234 is disposed at one end of the transparent tube 210 and the anode 232 is disposed at the other end of the transparent tube 210. The cold cathode 234 and the anode 232 can be respectively electrically connected to an external power source (not shown).

It is to be understood that the shape of the transparent tube 210 could also be in a form of prism or other similar shapes. A material of the transparent tube can be selected from a group comprising of glass, transparent resin material. In the illustrated embodiment, the light cut filter film 260 is an ultraviolet and infrared light cut filter film (UV-IR light cut filter film) that can block the ultraviolet light and infrared light from passing through the CCFL 200. The working gas 240 is a mixture of xenon (Xe), argon (Ar) and neon (Ne) gases.

Figure 3:
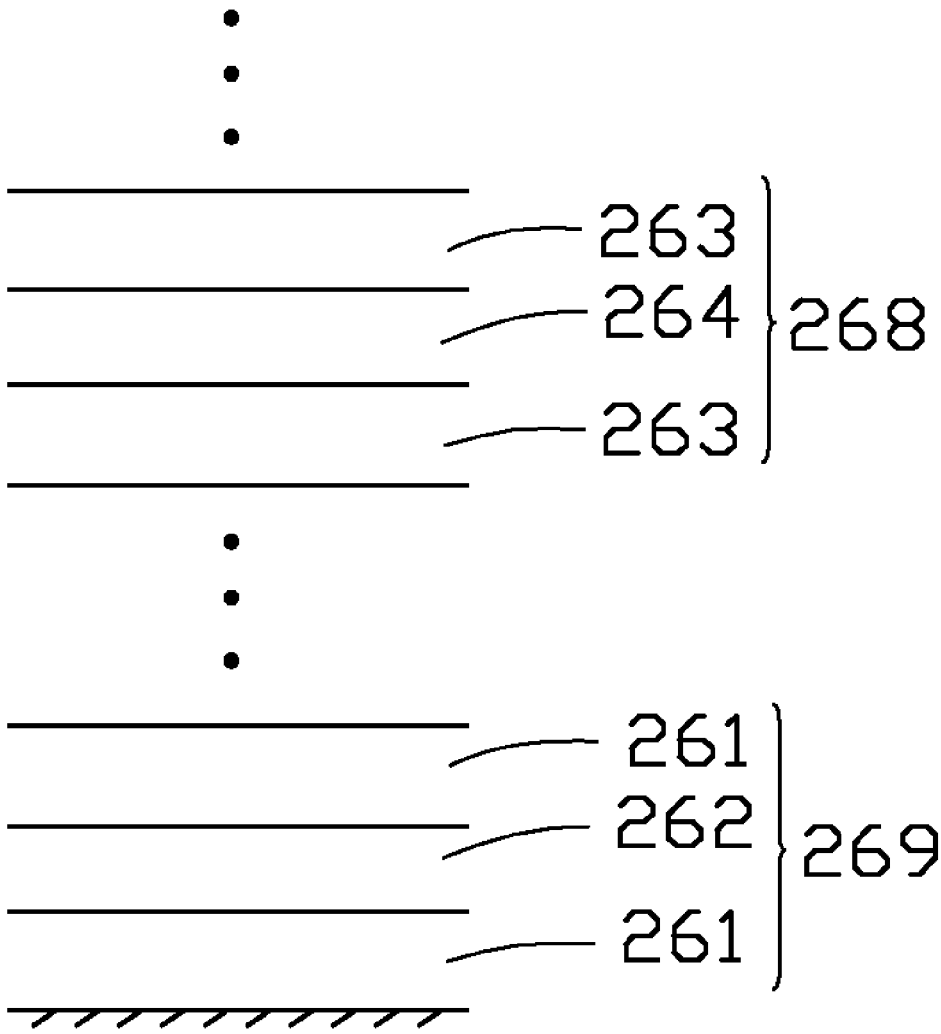
FIG. 3 is a schematic, cross-sectional view showing a structure of a light cut filter film of the CCFL of FIG. 2.

Referring to FIG. 3, the UV-IR light cut filter film has a stack structure. The stack structure comprises a plurality of high refractive index layers and a plurality of low refractive index layers. The stack structure can be defined as follows: $0.5(0.5HL0.5H)^2\times1.666(0.5LH0.5L)\times1.4(0.5LH0.5L)^6\times1.6(0.5LH0.5L)\times1.8(0.5LH0.\ 5L)^8$. Wherein, H represents a base thickness of a high refractive index layer which is equal to one fourth of a central wavelength (λ) associated with the filter film, L represents a base thickness of a low refractive index layer which is equal to one fourth of a central wavelength associated with the filter film, the expression enclosed in each parenthesis represents a filter cavity, and the superscript represents the number of repetition of the expression enclosed in that parenthesis. The numbers before the parenthesises represent thickness times for the respective filter cavities. For one example, $0.5(0.5HL0.5H)^2$ represents two consecutive filter cavities 269 each consisting of two high refractive index layers 261 and a low refractive index layer 262 sandwiched between the high refractive index layers 261. In each of the filter cavities 269, each of the high refractive index layers 261 has a thickness equal to $0.5\times(0.5\times(1/4)\lambda)$, and the low refractive index layer 262 has a thickness equal to $0.5\times(1/4)\lambda$. For another example, 1.666(0.5LH0.5L) represents only one filter cavity 268 consisting of two low refractive index layers 263 and a high refractive index layer 264 sandwiched between the low refractive index layers 263. In the filter cavity 268, each of the low refractive index layers 263 has a thickness equal to $1.666\times(0.5\times(1/4)\lambda)$, and the high refractive index layer 264 has a thickness equal to $1.666\times(1/4)\lambda$.

The refractive index of the high refractive index layer is in an approximate range from 2.1 to 2.4. A material of the high refractive index layer can be selected from a group consisting of titanium dioxide ($TiO_2$), titanium pentoxide ($Ti_2O_5$) and tantalum pentoxide ($Ta_2O_5$). The refractive index of the low refractive index layer is in an approximate range from 1.4 to 1.6. A material of the low refractive index layer can be selected from a group consisting of silicon dioxide ($SiO_2$) and aluminium oxide ($Al_2O_3$). In the illustrated embodiment, the high refractive index layer is made of titanium pentoxide and the low refractive index layer is made of silicon dioxide.

When the CCFL 200 in use, the cold cathode 234 and the anode 232 are supplied with a voltage by an external power source (not shown). An electric field is established between the cold cathode 234 and the anode 232. Electrons are emitted from the cold cathode 234 and accelerated by the electric field, and then collide with gaseous molecules of the working gas 240. This causes excitation of the working gas 240 and subsequent remission. The remission process causes radiation of ultraviolet rays. The ultraviolet rays irradiate a fluorescent material of the fluorescent layer 220, whereby a part of the ultraviolet rays are converted into visible lights and infrared lights. The ultraviolet lights and infrared lights can be effectively blocked by the UV-IR light cut filter film from emitting out of the CCFL 200.

Figure 4:
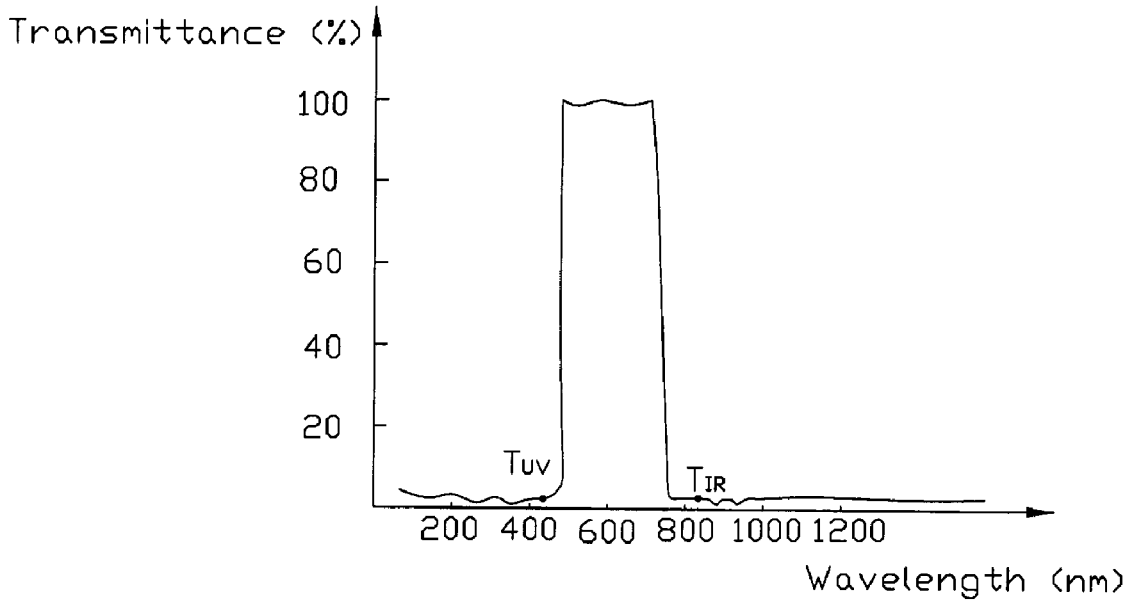
FIG. 4 is a graph showing a transmitted spectrum of the light cut filter film of the CCFL of FIG. 2.

FIG. 4 shows a graph of a transmitted spectrum of an UV-IR light cut filter film of the CCFL 200 of FIG. 2, wherein TUV is a dividing point of the ultraviolet light area and the visible light area, and wherein TIR is a dividing point of the visible light area and the infrared light area. It shows that ultraviolet light transmittance associated with the UV-IR light cut filter film is below 2% and infrared light transmittance associated therewith is also below 2%. Therefore, most part of ultraviolet lights and infrared lights are blocked by the UV-IR light cut filter film from emitting out of the CCFL 200.

It is to be understood that a light cut filter film of the present CCFL can also employs either ultraviolet light cut filter film or infrared light cut filter film. A preferred stack structure of the ultraviolet light cut filter film can be defined as follows: $(HL)^7\times(0.76\ LH0.76\ L)^6$ and a preferred stack structure of the infrared light cut filter film can be defined as follows: $5(HL)^7\times(1.3\ LH1.3\ L)^9(HL)^8$.

Figure 5:
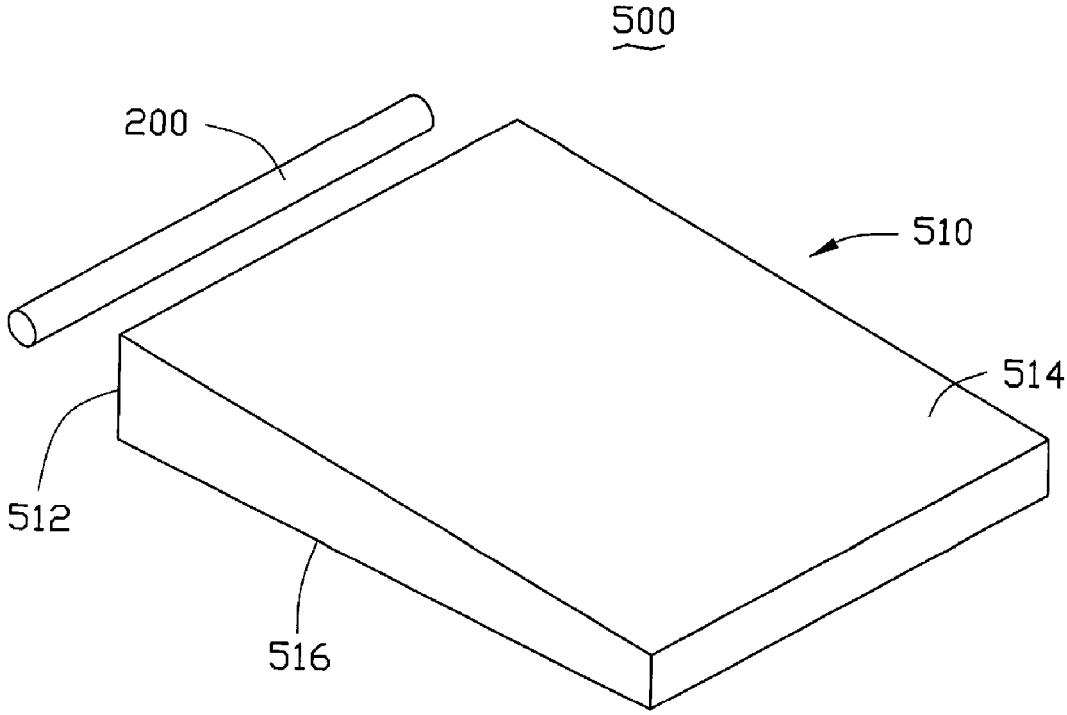
FIG. 5 is a schematic, isometric view of a backlight module according to a second preferred embodiment.

Referring to FIG. 5, a backlight module 500 using the CCFL 200, in accordance with a first preferred embodiment, is shown. The backlight module 500 includes a light guide plate 510 and a CCFL 200. The light guide plate 510 includes an incident surface 512; an emitting surface 514 adjoining the incident surface 512; and a reflecting surface 516 opposite to the emitting surface 514. The CCFL 200 is disposed adjacent the incident surface 512 of the light guide plate 510. The overall shape of the light guide plate 510 may be configured to be flat or wedge-shaped. In the illustrated embodiment, the shape of the light guide plate 510 is wedge-shaped.

Because of the CCFL 200 blocking most part of the ultraviolet light and infrared light to irradiate at the light guide plate 510, the light guide plate has a long service life without following problems such as thermal deformation, deflection, turn color and transformation. Therefore, the backlight module 500 using the CCFL 200 can improve optical uniformity, poor brightness, and worse optical performance. In addition, the present CCFL employs a mixture gas as a working gas to replace with a mercury vapor that is toxic to humans and environmentally unsafe, whereby the present CCFL is environment friendly.

Finally, while the present invention has been described with reference to particular embodiments, the description is illustrative of the invention and is not to be construed as limiting the invention. Therefore, various modifications can be made to the embodiments by those skilled in the art without departing from the true spirit and scope of the invention as defined by the appended claims.

What is claimed is:

1. A cold cathode fluorescent lamp, comprising:

a working gas;

a transparent tube receiving the working gas therein, the transparent tube having an inner surface and an outer surface;

a fluorescent layer formed on the inner surface of the transparent tube;

a cold cathode disposed at one end of the transparent tube;

an anode disposed at the other end of the transparent tube; and a filter film formed on the outer surface of the transparent tube, wherein the filter film is a UV-IR light cut filter film having a stack structure following a formula of $0.5(0.5HL0.5H)^2\times1.666(0.5LH0.5L)\times1.4(0.5LH0.5L)^6\times1.6(0.5LH0.5L)\times1.8(0.5LH0.5L)^8$, wherein H represents a base thickness of a high refractive index layer which is equal to one fourth of a central wavelength associated with the filter film, L represents a base thickness of a low refractive index layer which is equal to one fourth of a central wavelength associated with the filter film, the expression of 0.5HL0.5H represents a first filter cavity consisting of two high refractive index layers and a low refractive index layer sandwiched between the high refractive index layers, the expression of 0.5LH0.5L represents a second filter cavity consisting of two low refractive index layers and a high refractive index layer sandwiched between the low refractive index layers, the superscripts represent the numbers of repetition of the filter cavities, and the numbers before the parentheses represent thickness times for the respective filter cavities.

2. The cold cathode fluorescent lamp according to claim 1, wherein the transparent tube is one of a cylinder and a prism.

3. The cold cathode fluorescent lamp according to claim 1, wherein a material of the transparent tube can be selected from a group comprising of glass, transparent resin material.

4. The cold cathode fluorescent lamp according to claim 1, wherein the working gas is a mixture of xenon, argon and neon gases.

5. The cold cathode fluorescent lamp according to claim 1, wherein a material of the high refractive index layer is selected from a group consisting of titanium dioxide, titanium pentoxide and tantalum pentoxide.

6. The cold cathode fluorescent lamp according to claim 1, wherein a material of the low refractive index layer is selected from a group consisting of silicon dioxide and aluminium oxide.

7. The cold cathode fluorescent lamp according to claim 1, wherein a refractive index of the high refractive index layer is in the range from about 2.1 to about 2.4.

8. The cold cathode fluorescent lamp according to claim 1, wherein a refractive index of the low refractive index layer is in the range from about 1.4 to about 1.6.

9. A cold cathode fluorescent lamp, comprising:

a working gas;

a transparent tube receiving the working gas therein, the transparent tube having an inner surface and an outer surface;

a fluorescent layer formed on the inner surface of the transparent tube;

a cold cathode disposed at one end of the transparent tube;

an anode disposed at the other end of the transparent tube; and a filter film formed on the outer surface of the transparent tube, wherein the filter film is a UV light cut filter film having a stack structure following a formula of $(HL)^7\times(0.76LH0.76L)^6$, wherein H represents a high refractive index layer having a base thickness equal to one fourth of a central wavelength associated with the filter film, L represents a low refractive index layer having a base thickness equal to one fourth of a central wavelength associated with the filter film, the expression of HL represents a first filter cavity consisting of a high refractive index layer and a low refractive index layer stacked one on another, the expression of 0.76LH0.76L represents a second filter cavity consisting of two low refractive index layers and a high refractive index layer sandwiched between the low refractive index layers, and the superscripts represent the numbers of repetition of the filter cavities.

10. The cold cathode fluorescent lamp according to claim 9, wherein a material of the high refractive index layer is selected from a group consisting of titanium dioxide, titanium pentoxide and tantalum pentoxide.

11. The cold cathode fluorescent lamp according to claim 9, wherein a material of the low refractive index layer is selected from a group consisting of silicon dioxide and aluminium oxide.

12. The cold cathode fluorescent lamp according to claim 9, wherein a refractive index of the high refractive index layer is in the range from about 2.1 to about 2.4.

13. The cold cathode fluorescent lamp according to claim 9, wherein a refractive index of the low refractive index layer is in the range from about 1.4 to about 1.6.

14. A cold cathode fluorescent lamp, comprising:

a working gas;

a transparent tube receiving the working gas therein, the transparent tube having an inner surface and an outer surface;

a fluorescent layer formed on the inner surface of the transparent tube;

a cold cathode disposed at one end of the transparent tube;

an anode disposed at the other end of the transparent tube; and a filter film formed on the outer surface of the transparent tube, wherein the filter film is an IR light cut filter film having a stack structure following a formula of $5(HL)^7\times(1.3LH1.3L)^9\times(HL)^8$ wherein H represents a high refractive index layer having a base thickness equal to one fourth of a central wavelength associated with the filter film, L represents a low refractive index layer having a base thickness equal to one fourth of a central wavelength associated with the filter film, the expression of HL represents a first filter cavity consisting of a high refractive index layer and a low refractive index layer stacked one on another, the expression of 1.3LH1.3L represents a second filter cavity consisting of two low refractive index layers and a high refractive index layer sandwiched between the low refractive index layers, the superscripts represent the numbers of repetition of the filter cavities, and the numbers before the parenthesis represents thickness times for the respective filter cavity.

15. The cold cathode fluorescent lamp according to claim 14, wherein a refractive index of the high refractive index layer is in the range from about 2.1 to about 2.4.

16. The cold cathode fluorescent lamp according to claim 14, wherein a refractive index of the low refractive index layer is in the range from about 1.4 to about 1.6.

* * * * *

UNITED STATES PATENT AND TRADEMARK OFFICE

CERTIFICATE OF CORRECTION

PATENT NO. : 7,622,867 B2
APPLICATION NO. : 11/307737
DATED : November 24, 2009
INVENTOR(S) : Ga-Lane Chen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 950 days.

Signed and Sealed this

Twenty-sixth Day of October, 2010

David J. Kappos

David J. Kappos
*Director of the United States Patent and Trademark Office*